United States Patent [19]

Okada et al.

[11] Patent Number: 4,812,370

[45] Date of Patent: Mar. 14, 1989

[54] SURFACE COATED TUNGSTEN CARBIDE-BASE SINTERED HARD ALLOY MATERIAL FOR INSERTS OF CUTTING TOOLS

[75] Inventors: Yoshikazu Okada; Jun Sugawara; Sumiyoshi Takizawa, all of Tokyo, Japan

[73] Assignee: Mitsubishi Kinzoku Kabushiki Kaisha, Tokyo, Japan

[21] Appl. No.: 101,208

[22] Filed: Sep. 25, 1987

[30] Foreign Application Priority Data

Oct. 3, 1986 [JP] Japan ..... 61-235726

[51] Int. Cl.[4] ..... B22F 7/04

[52] U.S. Cl. ..... 428/552; 428/565

[58] Field of Search ..... 428/552, 565

[56] References Cited

U.S. PATENT DOCUMENTS

| | | |
|---|---|---|
| 4,035,541 | 7/1977 | Smith et al. . |
| 4,101,703 | 7/1978 | Schintlmeister . |
| 4,239,536 | 12/1980 | Yamamoto et al. . |
| 4,268,582 | 5/1981 | Hale et al. . |
| 4,337,300 | 6/1982 | Itaba et al. . |
| 4,343,865 | 8/1982 | Graham . |
| 4,450,205 | 5/1984 | Itaba et al. . |
| 4,554,201 | 11/1985 | Andreev et al. . |
| 4,594,294 | 6/1986 | Eichen et al. . |
| 4,610,931 | 9/1986 | Nemeth et al. . |
| 4,696,352 | 9/1987 | Buljan et al. . |

FOREIGN PATENT DOCUMENTS

| | | |
|---|---|---|
| 53-70905 | 6/1978 | Japan ..... 428/564 |
| 221369 | 10/1986 | Japan . |

*Primary Examiner*—John F. Terapane

*Assistant Examiner*—Eric Jorgensen

*Attorney, Agent, or Firm*—Frishauf, Holtz, Goodman & Woodward

[57] ABSTRACT

A surface coated tungsten carbide-base sintered hard alloy material for inserts of cutting tools having excellent wear resistance and toughness comprising (1) a substrate having an internal portion consisting essentially of 5–30 percent by weight of one composite metal carbo-nitride, as a compound forming a hard dispersion phase, selected from the group consisting of (Ti, W)CN, (Ti, Nb, W)CN, (Ti, Ta, W)CN, and (Ti, Nb, Ta, W)CN; 4–10 percent Co as a component forming a binder phase, and the balance of WC as a component forming the hard disperse phase and inevitable impurities; the substrate having a surface portion formed with a Co-enriched layer being substantially free of the composite metal carbo-nitride; and (2) a hard surface layer coated over the surface of the substrate, comprising an innermost layer consisting essentially of TiC, the innermost layer containing one of a W component and W and Co components diffused from the substrate; a diffusion preventing layer formed by one of a single layer of one compound selected from the group consisting of TiCN and TiN, or a double layer of both of the components TiCN and TiN; an inner layer consisting essentially of TiC, the diffusion preventing layer preventing diffusion of one of the W component and the W and Co components into said inner layer; and an outer layer formed by one of a single layer of one compound selected from the group consisting of TiCO, TiCNO, and $Al_2O_3$ and a double layer of two compounds selected from same.

9 Claims, No Drawings

SURFACE COATED TUNGSTEN CARBIDE-BASE SINTERED HARD ALLOY MATERIAL FOR INSERTS OF CUTTING TOOLS

BACKGROUND OF THE INVENTION

This invention relates to surface coated tungsten carbide-base sintered hard alloy materials for inserts of cutting tools (hereinafter abbreviated as coated cutting tool materials), of which surfaces are coated with a hard layer, and more particularly to cutting tool materials of this kind which exhibit very excellent cutting performance by virtue of excellent wear resistance and toughness thereof, when used not only in continuous cutting of steel but also in intermittent cutting of same.

Conventionally, there have been widely employed coated cutting tool materials formed of tungsten carbide(WC)-base sintered hard alloys. Coated cutting tool materials of this kind are typically produced by preparing as starting powders (Ti, W)C powder, TiC powder, NbC powder, TaC powder, (Ti, Nb)C powder, WC powder, and Co powder, etc., then blending them into a predetermined composition, kneading the blended powder into a mixed powder, compressing the mixed powder into a green compact, and sintering the green compact for 1–2 hours in a vacuum atmosphere under a pressure of $10^{-1}$ torr or less and at a temperature within a range from 1300° to 1500° C. The resulting cutting tool materials have substrates consisting essentially of: 5–30 percent by weight (hereinafter percentages are weight percentages throughout the whole specification) one composite metal carbide, as a component forming a hard disperse phase, selected from the group consisting of (Ti, W)C, (Ti, Nb, W)C, (Ti, Ta, W)C, and (Ti, Nb, Ta, W)C; 4–10 percent Co as a component forming a binder phase; and the balance of WC as another component forming the hard disperse phase and inevitable impurities. Each substrate is coated, by an ordinary coating method such as a chemical vapor deposition method or a physical vapor deposition method, with a hard coating layer composed of an inner layer consisting essentially of TiC and having a mean layer thickness of 2–8 microns, and an outer layer formed by a single layer of one component or a double layer of two compounds selected from the group consisting of TiCO, TiCNO, and $Al_2O_3$ and having a mean layer thickness of 0.3–3 microns.

Although cutting tools formed of the above conventional coated cutting tool materials exhibit excellent wear resistance when used in continuous cutting of steel, their cutting edges are liable to be chipped when used in intermittent cutting of steel due to insufficient toughness of their substrates, and hence the conventional cutting tools have rather short lives.

SUMMARY OF THE INVENTION

It is the object of the invention to provide surface coated tungsten carbide-base sintered hard alloy materials for inserts of cutting tools which possess excellent wear resistance and toughness, and therefore can exhibit excellent cutting performance when used in continuous cutting of steel as well as intermittent cutting of same.

The present invention provides a surface coated tungsten carbide-base sintered hard alloy material for inserts of cutting tools, comprising:

(1) a substrate formed of a tungsten crbide-base sintered hard alloy material having an internal portion consisting essentially of:

5–30 percent by weight one composite metal carbo-nitride, as a compound forming a hard disperse phase, selected from the group consisting of (Ti, W)CN, (Ti, Nb, W)CN, (Ti, Ta, W)CN, and (Ti, Nb, Ta, W)CN;

4–10 percent Co as a component forming a binder phase; and the balance of WC as a component forming the hard disperse phase and inevitable impurities;

the substrate having a surface portion formed with a Co-enriched layer being substantially free of the composite metal carbo-nitride; and (2) a hard surface layer coated over the surface of the substrate, comprising:

an innermost layer consisting essentially of TiC, the innermost layer containing one of a W component and W and Co components diffused from the substrate;

a diffusion preventing layer formed by one of a single layer of one compound selected from the group consisting of TiCN and TiN, or a double layer of both of the compounds TiCN and TiN, the diffusion preventing layer preventing diffusion of one of the W component and the W and Co component;

an inner layer consisting essentially of TiC; and an outer layer formed by one of a single layer of one compound selected from the group consisting of TiCO, TiCNO, and $Al_2O_3$ or a double layer of two compounds selected from same;

the innermost layer, the diffusion preventing layer, the inner layer, and the outer layer being superposed one upon another in the order mentioned.

Preferably, the Co content in the Co-enriched layer is within a range from 5 to 30 percent by weight, which is higher than that in the internal portion of the substrate.

Also preferably, the Co-enriched layer, innermost layer, diffusion preventing layer, inner layer, and outer layer have respective mean thicknesses within ranges from 5 to 30 microns, from 0.5 to 3 microns, from 0.5 to 3 microns, from 2 to 5 microns, and from 0.3 to 3 microns.

DETAILED DESCRIPTION

Under the aforestated circumstances, the present applicants have made many studies in order to improve the toughness of the substrates of the conventional surface coated hard alloy cutting tools. As a result, the applicants have reached the following findings:

(a) If (Ti, W)CN powder, TiC powder, TiN powder, NbC powder, TaC powder, (Ta, Nb)C powder, WC powder, and Co powder, etc. are prepared as starting powders, then they are blended into a predetermined composition, with the powders containing N being essential blending powders, the blended powder is kneaded into a mixed powder, the mixed powder is compressed into a green compact, and the green compact is sintered for 1–2 hours in a vacuum atmosphere under a pressure of $10^{-1}$ torr or less and at a temperature within a range from 1300° to 1500° C., the resulting WC-base hard alloy has an internal portion consisting essentially of:

5–30 percent one composite metal carbo-nitride, as a component forming a hard disperse phase, selected from the group consisting of (Ti, W)CN, (Ti, Nb, W)CN, (Ti, Ta, W)CN, and (Ti, Nb, Ta, W)CN;

4–10 percent Co as a component forming a binder phase; and the balance of WC as another compound forming the hard disperse phase and inevitable impurities, and a surface portion formed with a Co-enriched layer of a predetermined depth from the surface, which is substantially free of the above composite metal carbo-nitride, and therefore, has a Co content of 5–30 percent higher than that in the internal portion, and a WC content substantially equal to that in the internal portion. The formation of the Co-enriched layer has been caused by the movement of the composite metal carbo-nitride in the inward direction during sintering in vacuum.

The WC-base hard alloy has excellent toughness by virtue of the Co-enriched layer formed over the surface portion of the alloy.

If the matrix of the WC-base hard alloy is coated with a hard surface layer formed of an inner layer consisting essentially of TiC, and an outer layer formed by a single layer of one compound selected from the group consisting of TiCO, TiCNO, and $Al_2O_3$, or a double layer of two compounds selected from same, the resulting coated cutting tool has excellent toughness.

(b) However, although a coated cutting tool material formed of the above-mentioned WC-base hard alloy having the Co-enriched layer over the surface portion thereof as its substrate, has improved toughness and therefore exhibits excellent cutting performance in intermittent cutting of steel, a W component or W and Co components are diffused from the Co-enriched layer into the TiC layer during the formation of the TiC layer as the inner layer, resulting in degraded overall wear resistance of the hard surface layer, whereby desired cutting performance cannot be obtained in continuous cutting of steel.

(c) If an innermost layer consisting essentially of TiC is coated over the surface of the WC-base hard alloy substrate having the Co-enriched layer over the surface portion thereof, then a single layer of one component or a double layer of two compounds selected from the group consisting of TiCN and TiN is coated over the innermost layer, and then an inner layer of TiC is coated over the single layer or the double layer, a W component or W and Co components from the surface portion of the substrate are diffused into the innermost layer, but the W component or W and Co components can be prevented from diffusion into the inner layer of TiC by virtue of the intervention of the TiCN layer and/or TiN layer between the innermost layer and the inner layer. Therefore, the TiC layer as the inner layer will be free of the W component or W/Co components, whereby the hard surface layer will have excellent wear resistance.

The present invention is based upon the above findings.

The surface coated WC-base sintered hard alloy material for an insert of a cutting tool according to the invention has the aformentioned composition and structure.

In the coated cutting tool materials according to the invention, the composition, layer thickness, etc. have been limited within the previously stated ranges for the following reasons:

(a) Composite Metal Carbo-nitride Content:

Composite metal carbo-nitride contained in the substrate acts to enhance the heat resistance of the substrate. However, if the carbo-nitride content is less than 5 percent, desired heat resistance cannot be obtained. On the other hand, if the carbo-nitride content exceeds 30 percent, the toughness will be reduced. This is the reason why the carbo-nitride content has been limited within a range from 5 to 30 percent. Best results can be obtained if the same content is within a range from 5 to 20 percent.

(b) Co Content:

Co contained in the substrate acts to enhance the toughness of the substrate. However, if the Co content is less than 4 percent, desired toughness cannot be obtained, while if it exceeds 10 percent, the resulting cutting tool tends to be easily deformed. This is the reason why the Co content has been limited within a range from 4 to 10 percent. Best results can be obtained if the same content is within a range from 5 to 8 percent.

(c) Depth of Co-enriched Layer:

If the depth of the Co-enriched layer forming the surface portion of the substrate is less than 5 microns from the surface, desired toughness cannot be obtained, while if the depth exceeds 30 microns, it will result in degraded wear resistance. Therefore, the depth of the Co-enriched layer has been limited within a range from 5 to 30 microns. Best results can be obtained if the same mean thickness is within a range from 10 to 20 microns.

(d) Mean Thickness of Innermost Layer:

The innermost layer contains W and Co diffused from the surface portion of the substrate, and acts to enhance the bond strength of the hard surface layer with which it is bonded to the surface of the substrate. However, if the mean thickness of the innermost layer is less than 0.5 microns, the above action cannot be performed to a desired extent, while if the mean thickness exceeds 3 microns, no further increase in the bond strength can be obtained, and on the contrary the increased thickness of the innermost layer will impose a limitation on the thickness of the inner layer or the outer layer. Therefore, the mean thickness has been limited within a range from 0.5 to 3 microns. Best results can be obtained if the same mean thickness is within a range from 0.7 to 2 microns.

(e) Mean Thickness of Diffusion Preventing Layer:

If the mean thickness of the diffusion preventing layer is less than 0.5 microns, desired diffusion preventing effect cannot be obtained, while if the mean thickness exceeds 3 microns, it will result in degraded wear resistance of the hard surface layer. Therefore, the mean thickness has been limited within a range from 0.5 to 3 microns. Best results can be obtained if the same mean thickness is within a range from 1 to 2.5 microns.

(f) Mean Thickness of Inner layer and Outer Layer:

If either the mean thickness of the inner layer is less than 2 microns or that of the outer layer is less than 0.3 microns, desired wear resistance cannot be obtained, while if either the mean thickness of the inner layer exceeds 5 microns or that of the outer layer exceeds 3 microns, it will result in degraded chipping resistance of the hard surface layer. Therefore, the mean thickness of the inner layer has been limited within a range from 2 to 5 microns, and that of the outer layer within a range from 0.3 to 3 microns, respectively. Best results can be obtained if the same mean thicknesses are respectively within ranges from 3 to 4.5 microns for the inner layer and 0.5 to 2.5 microns for the outer layer.

Examples of the coated cutting tool materials according to the invention will now be described in detail.

EXAMPLE

The following starting powders were prepared: powder of $(Ti_{0.71}, W_{0.29})(C_{0.69}, N_{0.31})$, powder of TiC, powder of TiN, powder of NbC, powder of TaC, and powder of $(Ta_{0.83}, Nb_{0.17})C$, each having a mean grain size of 1 micron, powder of WC having a mean grain size of 3.5 microns, and powder of Co having a mean grain size of 1.2 microns.

These starting powders were blended into compositions shown in Table 1. The blended powders were each kneaded in a wet-type ball mill into a mixed powder for 72 hours, the mixed powder was then dried, and compressed under a pressure of 10 kg/mm$^2$ into a green compact having shape according to SNMG 120408 of ISO. The green compacts were sintered for 1.5 hours in a vacuum atmosphere under a pressure of $10^{-3}$ torr and at a temperature of 1420° C. Thus, substrates A–E of the coated cutting tool materials according to the invention were prepared, of which the internal portions have chemical compositions shown in Table 1, and surface portions have Co-enriched layers formed therein, the Co-enriched layers having Co contents at the layer central portions and mean depths from the surfaces of the substrates shown in Table 1, and being substantially free of composite metal carbo-nitride.

These powders were blended into compositions shown in Table 1, and the blended powders were processed under the same manufacturing conditions as those applied to the substrates A –E according to the present invention, whereby substrates A'–E' of conventional coated cutting tool materials were prepared, of which the internal portions have chemical compositions shown in Table 1, and which have homogeneous structures throughout the surface portions and internal portions.

Thereafter, the surfaces of the respective substrates thus obtained were coated with hard surface layers having respective chemical compositions and mean thicknesses shown in Table 2 by the ordinary chemical vapor deposition method, to thereby prepare coated cutting tool materials according to the invention Nos. 1–6, conventional coated cutting tool materials Nos. 1–6, and comparative coated cutting tool materials Nos. 1–3 which have neither innermost layer nor diffusion preventing layer.

Then, the above coated cutting tool materials were

TABLE 1

| SPECIMEN | COMPOSITION (WT %) HARD DISPERSE PHASE FORMING COMPOUND | Co | WC | INTERNAL COMPOSITION (WT %) HARD DISPERSE PHASE FORMING COMPOUND | Co | WC + IMPURITIES | Co-ENRICHED LAYER Co-CONTENT (WT %) | MEAN DEPTH (μm) |
|---|---|---|---|---|---|---|---|---|
| | SUBSTRATE OF COATED CUTTING INSERTS ACCORDING TO PRESENT INVENTION | | | | | | | |
| A | (Ti, W)CN:5 | 6 | bal. | $(Ti_{0.65}, W_{0.35})(C_{0.71}N_{0.29})$:5.9 | 6 | bal. | 10.2 | 12 |
| B | (Ti, W)CN:6, TaC:4 | 8 | " | $(Ti_{0.46}, Ta_{0.22}, W_{0.32})$ . $(C_{0.80}N_{0.20})$:12.4 | 8 | " | 16.5 | 18 |
| C | (Ti, W)CN:8, NbC:5 | 10 | " | $(Ti_{0.38}, Nb_{0.25}, W_{0.37})$ . $(C_{0.83}N_{0.17})$:15.1 | 10 | " | 18.0 | 20 |
| D | (Ti, W)CN:5.9, (Ta, Nb)C:4 | 6 | " | $(Ti_{0.44}, Ta_{0.18}, Nb_{0.06}, W_{0.32})$ . $(C_{0.80}N_{0.20})$:12.5 | 6 | " | 10.2 | 15 |
| E | TiC:1.3, TiN:1.1, TaC:3.6, NbC:0.4 | 6 | " | $(Ti_{0.44}, Ta_{0.18}, Nb_{0.06}, W_{0.32})$ . $(C_{0.80}N_{0.20})$:12.1 | 6 | " | 9.6 | 15 |
| | SUBSTRATE CONVENTIONAL COATED CUTTING INSERTS | | | | | | | |
| A' | (Ti, W)C:4.6 | 6 | bal. | $(Ti_{0.50}, W_{0.50})C$:5.9 | 6 | bal. | — | — |
| B' | (Ti, W)C:6, TaC:4 | 8 | " | $(Ti_{0.36}, Ta_{0.25}, W_{0.39})C$:12.2 | 8 | " | — | — |
| C' | (Ti, W)C:8, NbC:5 | 10 | " | $(Ti_{0.30}, Nb_{0.37}, W_{0.33})C$:15.9 | 10 | " | — | — |
| D' | (Ti, W)C:5.9, (Ta, Nb)C:4 | 6 | " | $(Ti_{0.35}, Ta_{0.23}, Nb_{0.05}, W_{0.37})$ . C:11.8 | 6 | " | — | — |
| E' | TiC:2.4, TaC:3.6, NbC:0.4 | 6 | " | $(Ti_{0.38}, Ta_{0.18}, Nb_{0.04}, W_{0.40})$ . C:11.3 | 6 | " | — | — |

To produce comparative substrates of conventional coated cutting tool materials, the following starting powders were prepared: powder of $(Ti_{0.58}, W_{0.42})C$, powder of TiC, powder of NbC, powder of TaC, and powder of $(Ta_{0.83}, Nb_{0.17})C$ each having a mean grain size of 1 micron, powder of WC having a mean grain size of 3.5 microns, and powder of Co having a mean grain size of 1.2 microns.

subjected to a test of continuous dry cutting of steel (hereinafter referred to as the cutting test A) under the following conditions:

Work Material: Round Bar according to SNCM 439 (hardness: HB 260)
Cutting Speed: 200 m per minute;
Feed Rate: 0.3 mm per rev.;
Depth of Cut: 1.5 mm;
Cutting Time: 15 minutes.

TABLE 2

| SPECIMEN | SUBSTRATE | HARD SURFICE LAYER: INNERMOST LAYER COMPOSITION | INNERMOST LAYER MEAN THICKNESS (μm) | DIFFUSION PREVENTING LAYER: FIRST LAYER COMPOSITION | FIRST LAYER MEAN THICKNESS (μm) | SECOND LAYER COMPOSITION | SECOND LAYER MEAN THICKNESS (μm) | THIRD LAYER COMPOSITION | THIRD LAYER MEAN THICKNESS (μm) |
|---|---|---|---|---|---|---|---|---|---|
| | | COATED CUTTING INSERTS ACCORDING TO PRESENT INVENTION | | | | | | | |
| 1 | A | TiC | 1 | TiN | 2 | — | — | — | — |
| 2 | B | TiC | 3 | TiCN | 2 | — | — | — | — |
| 3 | C | TiC | 1 | TiCN | 1 | TiN | 1 | TiCN | 1 |
| 4 | D | TiC | 1 | TiCN | 2 | — | — | — | — |

TABLE 2-continued

| | | | | | | | | | |
|---|---|---|---|---|---|---|---|---|---|
| 5 | E | TiC | 1.5 | TiCN | 1.5 | — | — | — | — |
| 6 | E | TiC | 0.5 | TiN | 0.5 | — | — | — | — |
| CONVENTIONAL COATED CUTTING INSERTS | | | | | | | | | |
| 1 | A' | — | — | — | — | — | — | — | — |
| 2 | B' | — | — | — | — | — | — | — | — |
| 3 | C' | — | — | — | — | — | — | — | — |
| 4 | D' | — | — | — | — | — | — | — | — |
| 5 | E' | — | — | — | — | — | — | — | — |
| 6 | E' | — | — | — | — | — | — | — | — |
| COMPARATIVE COATED CUTTING INSERTS | | | | | | | | | |
| 1 | A | — | — | — | — | — | — | — | — |
| 2 | E | — | — | — | — | — | — | — | — |
| 3 | E | — | — | — | — | — | — | — | — |

| | | HARD SURFICE LAYER | | | | | |
|---|---|---|---|---|---|---|---|
| | | | | OUTER LAYER | | | |
| | | INNER LAYER | | FIRST LAYER | | SECOND LAYER | |
| SPECIMEN | SUB-STRATE | COMPOSITION | MEAN THICKNESS (μm) | COMPOSITION | MEAN THICKNESS (μm) | COMPOSITION | MEAN THICK-NESS (μm) |
| COATED CUTTING INSERTS ACCORDING TO PRESENT INVENTION | | | | | | | |
| 1 | A | TiC | 4 | TiCNO | 0.5 | $Al_2O_3$ | 1.5 |
| 2 | B | TiC | 2 | $Al_2O_3$ | 0.3 | — | — |
| 3 | C | TiC | 4 | $Al_2O_3$ | 2.5 | — | — |
| 4 | D | TiC | 4 | TiCNO | 0.5 | $Al_2O_3$ | 1.5 |
| 5 | E | TiC | 3.5 | TiCO | 0.5 | $Al_2O_3$ | 1.5 |
| 6 | E | TiC | 5 | $Al_2O_3$ | 3 | — | — |
| CONVENTIONAL COATED CUTTING INSERTS | | | | | | | |
| 1 | A' | TiC | 7 | TiCNO | 0.5 | $Al_2O_3$ | 1.5 |
| 2 | B' | TiC | 7 | $Al_2O_3$ | 0.3 | — | — |
| 3 | C' | TiC | 8 | $Al_2O_3$ | 2.5 | — | — |
| 4 | D' | TiC | 7 | TiCNO | 0.5 | $Al_2O_3$ | 1.5 |
| 5 | E' | TiC | 6.5 | TiCO | 0.5 | $Al_2O_3$ | 1.5 |
| 6 | E' | TiC | 6 | $Al_2O_3$ | 3 | — | — |
| COMPARATIVE COATED CUTTING INSERTS | | | | | | | |
| 1 | A | TiC | 7 | TiCNO | 0.5 | $Al_2O_3$ | 1.5 |
| 2 | E | TiC | 6.5 | TiCO | 0.5 | $Al_2O_3$ | 1.5 |
| 3 | E | TiC | 6 | $Al_2O_3$ | 3 | — | — |

The above cutting tool materials were also subjected to another test of continuous dry cutting of steel (hereinafter referred to as the cutting test B) under the following conditions:

Work Material: Round Bar according to SNCM 439 (hardness: HB 280)
Cutting Speed: 140 m per minute;
Feed Rate: 0.4 mm per rev.;
Depth of Cut: 2 mm;
Cutting Time: 15 minutes The above cutting tool materials were further subjected to a test of intermittent dry cutting of steel (hereinafter referred to as cutting test C) under the following conditions:

Work Material: Round Bar with 4 grooves according to SNCM 439 (hardness: HB 310)
Cutting Speed: 140 m per minute;
Feed Rate: 0.25 mm per rev.
Depth of Cut: 2 mm In the above cutting tests A and B, the flank wear of each cutting insert was measured, while in the above cutting test C, cutting time before each cutting insert was chipped was measured. The results of the measurements are shown in Table 3 as an average value of every ten cutting inserts.

It will be learned from Table 3 that the coated cutting tool materials Nos. 1–6 according to the invention possess excellent toughness by virtue of their Co-enriched layers formed over the surface portions of the substrates, as well as excellent wear resistance by virtue of their inners layer and outer layers which are free of W and Co, whereby excellent cutting performance was exhibited in both the continuous cutting of steel and the intermittent cutting of same.

TABLE 3

| SPECIMEN | FLANK WEAR OF CUTTING EDGE SUBJECTED TO TEST A (mm) | FLANK WEAR OF CUTTING EDGE SUBJECTED TO TEST B (mm) | CUTTING TIME IN TEST C (MIN.) |
|---|---|---|---|
| COATED CUTTING INSERTS ACCORDING TO PRESENT INVENTION | | | |
| 1 | 0.13 | 0.11 | 28.1 |
| 2 | 0.19 | 0.18 | 34.3 |
| 3 | 0.21 | 0.23 | 38.2 |
| 4 | 0.11 | 0.12 | 29.5 |
| 5 | 0.13 | 0.08 | 31.7 |
| 6 | 0.09 | 0.13 | 25.6 |
| CONVENTIONAL COATED CUTTING INSERTS | | | |
| 1 | 0.28 | 0.26 | 4.3 |
| 2 | 0.35 | 0.36 | 6.1 |
| 3 | 0.39 | 0.41 | 7.3 |
| 4 | 0.27 | 0.25 | 3.5 |
| 5 | 0.29 | 0.28 | 4.9 |
| 6 | 0.25 | 0.29 | 2.8 |
| COMPARATIVE COATED CUTTING INSERTS | | | |
| 1 | 0.61 | 0.63 | 14.5 |
| 2 | 0.72 | 0.69 | 17.3 |
| 3 | 0.53 | 0.72 | 12.8 |

On the other hand, although the conventional coated cutting tool materials Nos. 1–6 exhibit somewhat excellent cutting performance in the continuous cutting of steel, they showed short service lives in the intermittent cutting of steel, since their substrate structures are homogeneous throughout the surface portions and internal portions and hence have insufficient toughness. Further, although the comparative coated cutting tool materials Nos. 1–3 have such sufficient toughness that they exhibited excellent cutting performance in the intermittent cutting of steel, they showed remarkable wear when used in the continuous cutting of steel, since their hard surface layers had neither innermost layer nor diffusion preventing layer so that W and Co components were diffused from the Co-enriched layer into the inner layer during formation of the latter.

As stated above, the coated cutting tool materials according to the invention have both excellent wear resistance and toughness, and therefore can exhibit excellent cutting performance not only when used in continuous cutting of steel but also when used in intermittent cutting of same.

What is claimed is:

1. A surface coated tungsten carbide-base sintered hard alloy material for an insert of a cutting tool, comprising:

(1) a substrate formed of a tungsten carbide base sintered hard alloy having an internal portion consisting essentially of:

5–30 percent by weight of one composite metal carbo-nitride, as a compound forming a hard disperse phase, selected from the group consisting of (Ti, W)CN, (Ti, Nb, W)CN, (Ti, Ta, W)CN, and (Ti, Nb, Ta, W)CN;

4–10 percent Co as a component forming a binder phase, and the balance of WC as a component forming said hard disperse phase and inevitable impurities;

said substrate having a surface portion formed with a Co-enriched layer being substantially free of said composite metal carbo-nitride; and (2) a hard surface layer coated over the surface of said substrate, comprising:

an innermost layer consisting essentially of TiC, said innermost layer containing one of a W component and W and Co components diffused from said substrate;

a diffusion preventing layer formed by one of a single layer of one compound selected from the group consisting of TiCN and TiN or a double layer of both of said compounds TiCN and TiN, said diffusion preventing layer preventing diffusion of one of said W component and said W and Co components;

an inner layer consisting essentially of TiC; and an outer layer formed by one of a single layer of one compound selected from the group consisting of TiCO, TiCNO, and $Al_2O_3$ and a double layer of two compounds selected from same;

said innermost layer, said diffusion preventing layer, said inner layer, and said outer layer being superposed one upon another in the order mentioned.

2. The surface coated tungsten carbide-base sintered hard alloy material for an insert of a cutting tool as claimed in claim 1, wherein the Co content in said Co-enriched layer is within a range from 5 to 30 percent by weight, which is higher than that in said internal portion of said substrate.

3. The surface coated tungsten carbide-base sintered hard alloy material for an insert of a cutting tool as claimed in claim 1, wherein said Co-enriched layer has a mean thickness within a range from 5 to 30 microns.

4. The surface coated tungsten carbide-base sintered hard alloy material for an insert of a cutting tool as claimed in claim 1, wherein said innermost layer has a mean thickness within a range from 0.5 to 3 microns.

5. The surface coated tungsten carbide-base sintered hard alloy material for an insert of a cutting tool as claimed in claim 1, wherein said diffusion preventing layer has a mean thickness within a range from 0.5 to 3 microns.

6. The surface coated tungsten carbide-base sintered hard alloy material for an insert of a cutting tool as claimed in claim 1, wherein said inner layer has a mean thickness within a range from 2 to 5 microns.

7. The surface coated tungsten carbide-base sintered hard alloy material for an insert of a cutting tool as claimed in claim 1, wherein said outer layer has a mean thickness within a range from 0.3 to 3 microns.

8. The surface coated tungsten carbide-base sintered hard alloy material for an insert of a cutting tool as claimed in claim 1, wherein the Co content in said Co-enriched layer is within a range from 5 to 30 percent by weight, which is higher than that in said internal portion of said substrate;

said Co-enriched layer has a mean thickness within a range from 5 to 30 microns;

said innermost layer has a mean thickness within a range from 0.5 to 3 microns;

said diffusion preventing layer has a mean thickness within a range from 0.5 to 3 microns;

said inner layer has a mean thickness within a range from 2 to 5 microns; and said outer layer has a mean thickness within a range from 0.3 to 3 microns.

9. The surface coated tungsten carbide-base sintered hard alloy material for an insert of a cutting tool as claimed in claim 1, wherein the Co content in said Co-enriched layer is within a range from 5 to 20 percent by weight, which is higher than that in said internal portion of said substrate;

said Co-enriched layer has a mean thickness within a range from 10 to 20 microns;

said innermost layer has a mean thickness within a range from 0.7 to 2 microns;

said diffusion preventing layer has a mean thickness within a range from 1 to 2.5 microns;

said inner layer has a mean thickness within a range from 3 to 4.5 microns; and said outer layer has a mean thickness within a range from 0.5 to 2.5 microns.

* * * * *